United States Patent [19]

Goldy

[11] 4,205,823

[45] Jun. 3, 1980

[54] STAPLE REMOVER

[76] Inventor: Sidney Goldy, Boulder City, Nev.

[21] Appl. No.: 936,231

[22] Filed: Aug. 24, 1978

[51] Int. Cl.[2] ..... B25C 11/00

[52] U.S. Cl. ..... 254/28

[58] Field of Search ..... 7/166; 254/28, 120, 254/131, 25, 21

[56] References Cited

U.S. PATENT DOCUMENTS

| | | | |
|---|---|---|---|
| 171,129 | 12/1875 | Hermance | 254/25 |
| 1,551,228 | 8/1925 | White | 254/131 |
| 1,802,687 | 4/1931 | Vrana | 254/28 |
| 1,929,567 | 10/1933 | Shepherd | 254/28 |
| 2,711,109 | 6/1955 | Gillstrom | 254/28 |
| 3,134,574 | 5/1964 | Reuterfors | 254/131 |
| 3,825,226 | 7/1974 | Appleman | 254/28 |

*Primary Examiner*—Robert C. Watson
*Attorney, Agent, or Firm*—Seiler & Quirk

[57] ABSTRACT

Apparatus for removing staples from cartons has an L-shaped, single piece body having an elongated, slightly arcuate blade member having a thin tip at the forward end and a vertical handle extending upwardly from the rearward portion. The blade is a rigid, wedge shaped member, substantially rectangular in cross-section, with the upper and lower surfaces of the blade being slightly concave in cross-section.

7 Claims, 6 Drawing Figures

STAPLE REMOVER

BACKGROUND OF THE INVENTION

Staple pullers of various shapes and functional designs have been well known for many years. The most popular type of staple puller currently in common office use comprises a pair of hinged jaws which engage the staple from opposite sides and which wedge the staple upwardly from the paper. Another type of staple puller which is well known is a wedge shaped member which is inserted under the staple and pushed forward, forcing the staple out from the paper.

Various examples of such staple pullers are found in the patent literature. For example, Cochran, U.S. Pat. No. 910,173, shows a device having a linearly aligned handle and shank portion which terminates in a narrow inclined tip which is placed beneath the staple and which removes the staple by a lifting cam action actuated by pressing downwardly on the handle. This device tends to bend the staples in the middle to form an apex as they are removed, thereby precluding subsequent reuse. Goessel, U.S. Pat. No. 2,400,988, shows a linear device having two outwardly and upwardly extending flanges at the tip which act as wedges to lift the staple from the paper. A pair of horizontal slots in the flanges retain the staple as it is lifted from the paper. This device has a flat base which slides along the upper edge of the paper until the staple is caught in the slots.

Staple removers having wedge shaped operating surfaces are disclosed in Palmer, U.S. Pat. No. 2,375,942, and Viel, U.S. Pat. No. 3,625,482. Palmer shows a straight staple puller having a thin blade with a pair of wedges on each side of the blade and increasing in thickness towards the rear of the blade. The Viel patent also shows a wedge-shaped blade having a flat bottom similar to the Palmer device, except that the handle is a hollow receptacle which automatically receives detached staples.

All of the devices of the prior art are particularly designed to remove staples from multiple sheets of paper or from light fabric, but are not designed for heavy duty use such as on staples normally used to close packing cartons. These staples are much larger and more rigid than small paper staples, typically being about 2½" long, ⅛" wide, and 1/32" thick. The force needed to remove these staples from packing cartons by a wedge or camming type action is much greater than that required to remove paper staples; accordingly, it has been found that the design parameters useful for paper staples do not apply to a device for removing carton staples. Because the force required to remove the staples is quite large, the normal hammertype grip shown in the devices of the art is not practical. It has been found that the user's hand slides forward and may slip, causing the possibility of injury on any sharp or projecting surfaces from the device. In addition, it is found that proper leverage to remove the staple cannot be obtained with this type of grip. Also, friction created between the carton surface and the staple puller, and between the staple and the staple puller, become very important forces to overcome when removing heavy-duty industrial staples.

Accordingly, it is an object of the invention to provide a relatively inexpensive, easy to manufacture, and simple apparatus to remove staples from cartons. It is another object of the invention to provide a device for removing staples from cartons which does not deform the staples, thereby permitting their reinsertion into the carton. It is yet another object of the invention to provide a staple puller having a blade with a cross-sectional design which minimizes frictional contact with surfaces contacting the blade. It is a further object of the invention to provide a carton staple puller which is completely safe, leaving no possibility for a staple to fly off and injure the user, and having no sharp edges. These and other objects are provided by the staple remover of the invention, a specific preferred embodiment of which is disclosed in detail herein.

SUMMARY OF THE INVENTION

A device for removing staples from cartons comprises a rigid blade member having a flat tip portion, said blade member having an arcuate bottom surface, and having a cross-section having slightly concave upper and lower edges, and a handle extending vertically from the rear portion of the blade.

BRIEF DESCRIPTION OF THE DRAWINGS

The invention is best understood with reference to the drawings, in which.

DETAILED DESCRIPTION OF THE INVENTION

Figure 1:
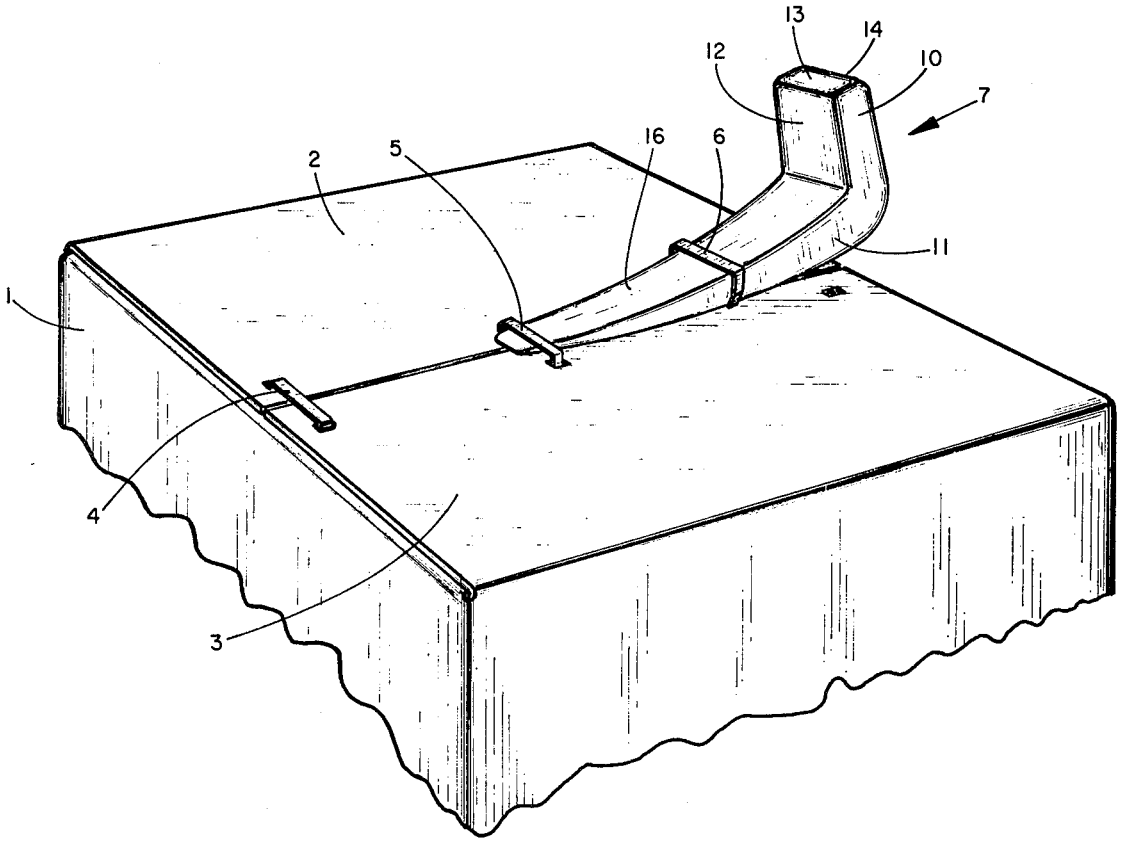
FIG. 1 is a perspective view showing a staple remover of the invention having the tip inserted under a carton staple.

Referring to FIG. 1, carton 1 has flaps 2 and 3 folded over perpendicularly oriented bottom flaps (not shown), which are fastened with staples 4, 5, and 6. Staple remover 7 is shown in FIG. 1 as having removed staple 6 and as being in position to remove staple 5. After the tip of the staple puller is inserted under the staple as shown in FIG. 1, the device is pushed straight forward toward the staple, lifting the staple directly upwardly by the vertical force exerted on the staple by the wedge of the staple remover.

Figure 2:
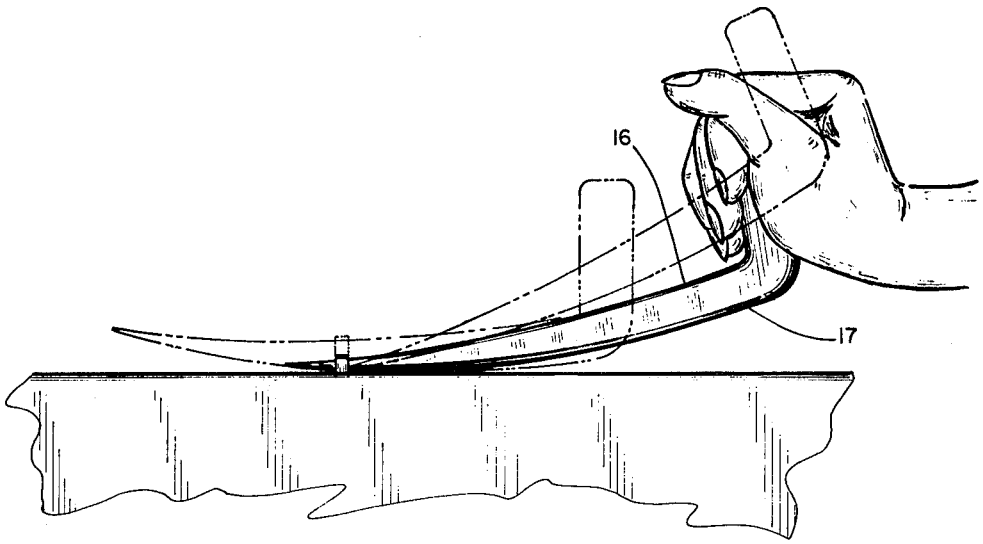
FIG 2 is a side elevational view of the staple puller, with the path of travel of the staple puller shown in phantom.

The staple remover consists of a handle portion 10 located at the rear of a blade member 11. The handle is a vertical projection substantially rectangular in shape having front vertical surface 12, top surface 13, and rear surface 14. Rear surface 14 is flat and adapted to fit in the palm of the user's hand as shown in FIG. 2. As seen from the top in FIG. 6, the rear portion of the balde is of the same width as the handle, with a gradual tapering of the blade width to a relatively blunt tip 15.

The design of the blade of the staple remover of the invention is very important. Firstly, the blade is wedge shaped in thickness, there being a substantially greater distance between upper surface 16 and lower surface 17 at the rear of the bade near the handle than at the tip, where the upper and lower surfaces converge. In addition, both upper and lower surfaces are arcuate, having a slight upward curvature. The curvature of the lower surface provides a significant advantage over a flat lower surface, in that only a small area of the bottom surface of the staple remover is in contact with the carton during any portion of the traverse of the remover under the staple. The curved portions of the edges of the bottom surface form in effect a pair of runners on which the device slides beneath the staple. This minimizes friction, and permits the staple remover to slide freely under and through the staple.

Figure 3:
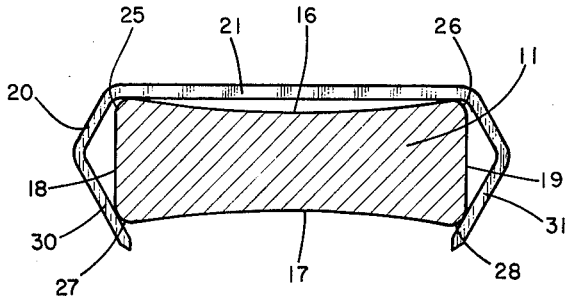
FIG. 3 is a cross-sectional view of the staple remover showing a staple thereon.

Another important feature of the invention is the specific design of the cross-section of the blade. Referring to FIG. 3, a cross-section of the blade 11 is shown with a removed staple 20 thereon. As shown in the drawing, the blade has upper surface 16, lower surface 17 and outside surfaces 18 and 19. Both upper surface 16 and lower surface 17 are slightly concave in shape; as a result, the upper surface contacts the horizontal cross piece 21 only at the outside edges 25 and 26 of the blade. The outside edges 25 and 26 form a set of parallel runners on which the staple rides as the devices passes under it. As the removal of the staple nears completion, the outside lower edges 27 and 28 of the blade will also come in contact and spread the feet 30 and 31 of the staple. The lower edges 27 and 28 of the blade are curved and smooth to permit steady, gradual opening of the feet of the staple along the surface, and to prevent cutting of the carton by a sharp edge.

As can be seen from FIG. 3, because of the concave design of the bottom surface of the blade, the outer portions 27 and 28 of the blade contact the carton as the blade slides under the staple, acting as runners with very little friction. Accordingly, it can be seen that in travelling under the staple, friction between the staple, the blade, and the carton is minimized by reducing the carton contact therebetween to a very short portion longitudinally of arcuate bottom blade surface 17, and laterally to two points between the blade and the staple and two points between the staple and the carton. This design permits efficient removal of staples from cartons with a minimum loss of energy to friction. Because the staples are very stiff and strong, it is important for a user to be able to direct as much of his useful energy as possible into the outward bending of the staple.

The use of the staple remover of the invention is very simple. First, the handle of the device is placed in the hand of the user, with the heel of the hand placed behind the handle as shown in FIG. 2. The tip of the device is then inserted under the staple, with the device being held at an elevated angle as shown in phantom in FIG. 2. After the tip is inserted, the handle is moved downward toward the carton to place the device in position for forward movement. Care should be taken not to use the tip as a lever to pry the staple upwardly, since this could result in breakage of the tip. After the handle has been lowered, the user pushes the staple remover straight forward, following approximately a path shown in phantom in FIG. 2. As the device is pushed forwardly, the wedge-shaped blade raises the staple from the carton, and the rounded bottom edges of the blade contact and separate the feet of the staple as shown in FIG. 3. The staple then remains on the back of the blade (see staple 6 in FIG. 1) and the staple remover may be used for removal of the next adjacent staple.

Figure 4:
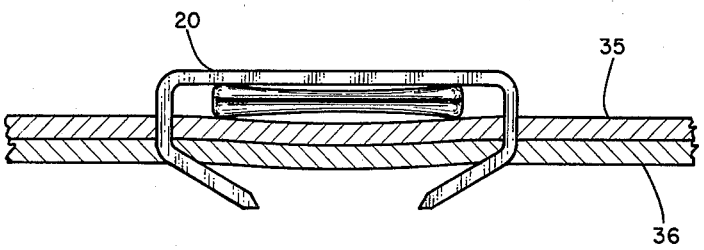
FIG. 4 is a similar cross-sectional view showing an early stage of removal of a staple.
Figure 5:
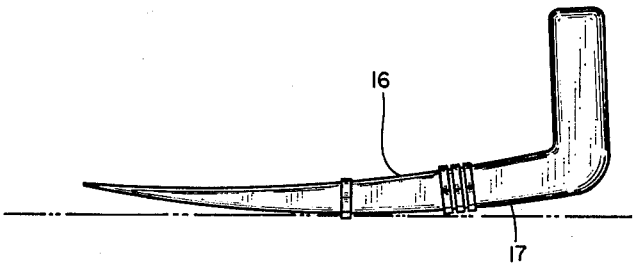
FIG. 5 is a side view of the staple remover showing several removed staples in place.
Figure 6:
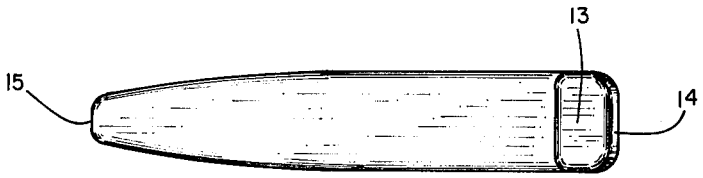
FIG. 6 is a top view of the device.

After the tip of the staple remover is inserted under a staple as shown in FIG. 1, the system assumes a cross-sectional configuration shown in FIG. 4. Initially, the tip wedges between the carton flaps 35 and 36 and the staple 20, raising the staple slightly above the carton and creating a slight outward pressure on the staple feet. As the forward progress of the device continues, the width and thickness of the proportion of the staple remover beneath the staple increases, with the lower curved surfaces of the device eventially contacting the staple feet as shown in FIG. 3. The increase in thickness with distance is illustrated in FIG. 5, whereas the increase in width of the device with distance is shown in FIG. 6. Removed staples can simply be retained on the shaft of the blade as shown in FIG. 5, thereby enabling speedy removal of a series of staples.

An additional surprising feature of the staple remover of the invention is that staples removed from cartons with this device may easily be replaced in the cartons by hand. If, for example, an inspector wishes to quickly check the contents of a box, he can remove the staples, leaving them on the shaft as shown in FIG. 5, remove the staples from the shaft after the inspection is complete, and reinsert the staples by hand back into the box. Because of the residual springback characteristics of the staples, and because the staples are not deformed by the remover, a satisfactory sealing closure may be obtained with reused staples.

The staple remover may be manufactured from any materials which provide the combination of strength, durability, and rigidity required in the device. A particularly useful material is non-cellular polyurethane casting material of the type sold by T. A. Davies Company of Tustin, California under the trade name TADCO 1-B-V. The raw materials are mixed and poured into a suitable mold such as RTV silicone, metal, epoxy, or other releaseable mold. The mold should not be so thermally conductive that the exothermic reaction heat is removed before the product is cured. After curing, the part is removed from the mold and can be used directly. Other plastics or metal may be used; however, the polyurethane material has been found to provide ideal durability and strength combination, while allowing a slight flexibility in the tip which is desirable to assist insertion under the staples.

While the invention has been described with respect to a specific embodiment thereof, certain changes and modifications may be made within the spirit and scope of the invention. Accordingly, the invention should not be considered limited by the foregoing description, but should be defined only by the following claims.

I claim:

1. A device for removing staples from a carton comprising a rigid, elongated blade having a flat, thin tip, a body portion having substantially horizontal upper and lower surfaces extending rearwardly from the tip with gradually increasing thickness, said body portion having an arcuate bottom edge, said upper surface of the blade comprising a pair of curved, spaced elongated runners for supporting and lifting a staple when the blade is moved along its length under the staple, and handle means for gripping the device comprising a member extending vertically upwardly from the rear portion of the blade having a rear surface adapted to fit the palm of a user's hand, said handle having a height substantially less than the length of the blade.

2. The device of claim 1 wherein the width of the blade increases gradually from the tip portion to the handle.

3. The device of claim 1 wherein the tip of the blade is slightly flexible to facilitate insertion under a carton staple.

4. The device of claim 1 wherein the lower surface of the blade comprises at its outer edges a pair of curved, spaced, elongated runners.

5. The device of claim 1 wherein the handle means comprises a vertical member having a rear surface adapted to fit the palm of a user's hand.

6. The device of claim 1 wherein the upper surface of the blade comprises a pair of elongated runners for contacting a staple, and the lower surface of the blade comprises a pair of elongated runners for contacting a carton.

7. The device of claim 1 wherein the blade has a substantially rectangular cross-section, the rectangle having curved corner portions, and slightly concave upper and lower edges.

* * * * *